US006575780B1

(12) United States Patent
Lee

(10) Patent No.: US 6,575,780 B1
(45) Date of Patent: Jun. 10, 2003

(54) ELECTRICAL CONNECTOR FOR TERMINATING AN EXTERNAL CABLE

(75) Inventor: George Lee, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/133,192

(22) Filed: Apr. 26, 2002

(51) Int. Cl.[7] ..... H01R 4/24

(52) U.S. Cl. ..... 439/404; 439/405

(58) Field of Search ..... 439/404, 405, 439/417, 459, 460, 470

(56) References Cited

U.S. PATENT DOCUMENTS 4,537,455 A * 8/1985 Vertenten et al. ..... 439/404
4,925,401 A * 5/1990 Fogg et al. ..... 439/404

* cited by examiner

*Primary Examiner*—Tho D. Ta
(74) *Attorney, Agent, or Firm*—Wei Te Chung

(57) ABSTRACT

An electrical connector assembly (100) includes an IDC connector and a cable (40). The IDC connector has a base (10) receiving a plurality of IDC contacts (50), a cover (20) assembled on the base, and a strain relief member (30) secured on the base and the cover. The strain relief member has a main portion (31), a holding cap (32) integrally formed on the main portion, and a pair of locking legs (33) extending downwardly from the main portion. The locking legs each has an outwardly projecting hook (330) for engaging within the base to lock the cable in its terminated position.

2 Claims, 3 Drawing Sheets

ELECTRICAL CONNECTOR FOR TERMINATING AN EXTERNAL CABLE

BACKGROUND OF THE INVENTION

1. Field of the Invention

The present invention relates to an electrical connector, and particularly to an electrical connector for terminating an external cable and mating with a header which is mounted on a printed circuit board.

2. Description of Prior Art

U.S. Pat. No. 5,125,850 and U.S. Pat. No. 5,762,513 respectively disclose an electrical connector for terminating a cable, each connector having a housing with a plurality of contacts received therein, a termination cover detachably assembled on the housing, and a strain relief device. The strain relief device is movable toward the termination cover and housing to aid the cover in maintaining the cable in its connected position. Similar configurations can also be found in U.S. Pat. Nos. 5,417,584; 5,108,306; 4,295,704 and U.S. Pat. No. 5,011,430.

However, in some applications, a strain relief device having a high profile is desired to allow users to withdrawal the connector more easily from electrical components located on a board or in a certain apparatus. The two kinds of strain relief devices mentioned in the above two patents do not meet the height and configuration requirements which will allow easy removal of the connector from a circuit board while still maintaining the original mechanical functions and capabilities.

Hence, an improved strain relief device is required to overcome the disadvantages of the prior art.

BRIEF SUMMARY OF THE INVENTION

The object of the present invention is to provide an electrical connector for terminating a cable, the connector having an improved strain relief member with a high profile and a simple configuration.

In order to achieve the above-mentioned object, an electrical connector assembly in accordance with the present invention comprises an IDC connector and an external cable. The IDC connector has an insulating base receiving therein a plurality of IDC contacts for piercing individual wires of the cable, a terminating cover assembled on the base for terminating the cable thereto, and a strain relief member secured on the insulating base and the terminating cover. The strain relief member has an upwardly extending main portion with a pair of slots being defined therein, a holding cap integrally formed on a topside of the main portion, and a pair of locking legs extending downwardly from opposite bottom sides of the main portion. The locking legs each has an outwardly projecting hook for engaging with a corresponding yoke formed on opposite ends of the insulating base, thus maintaining the cable in its terminated position.

Other objects, advantages and novel features of the invention will become more apparent from the following detailed description of the present embodiment when taken in conjunction with the accompanying drawings.

DETAILED DESCRIPTION OF THE INVENTION

Figure 1:
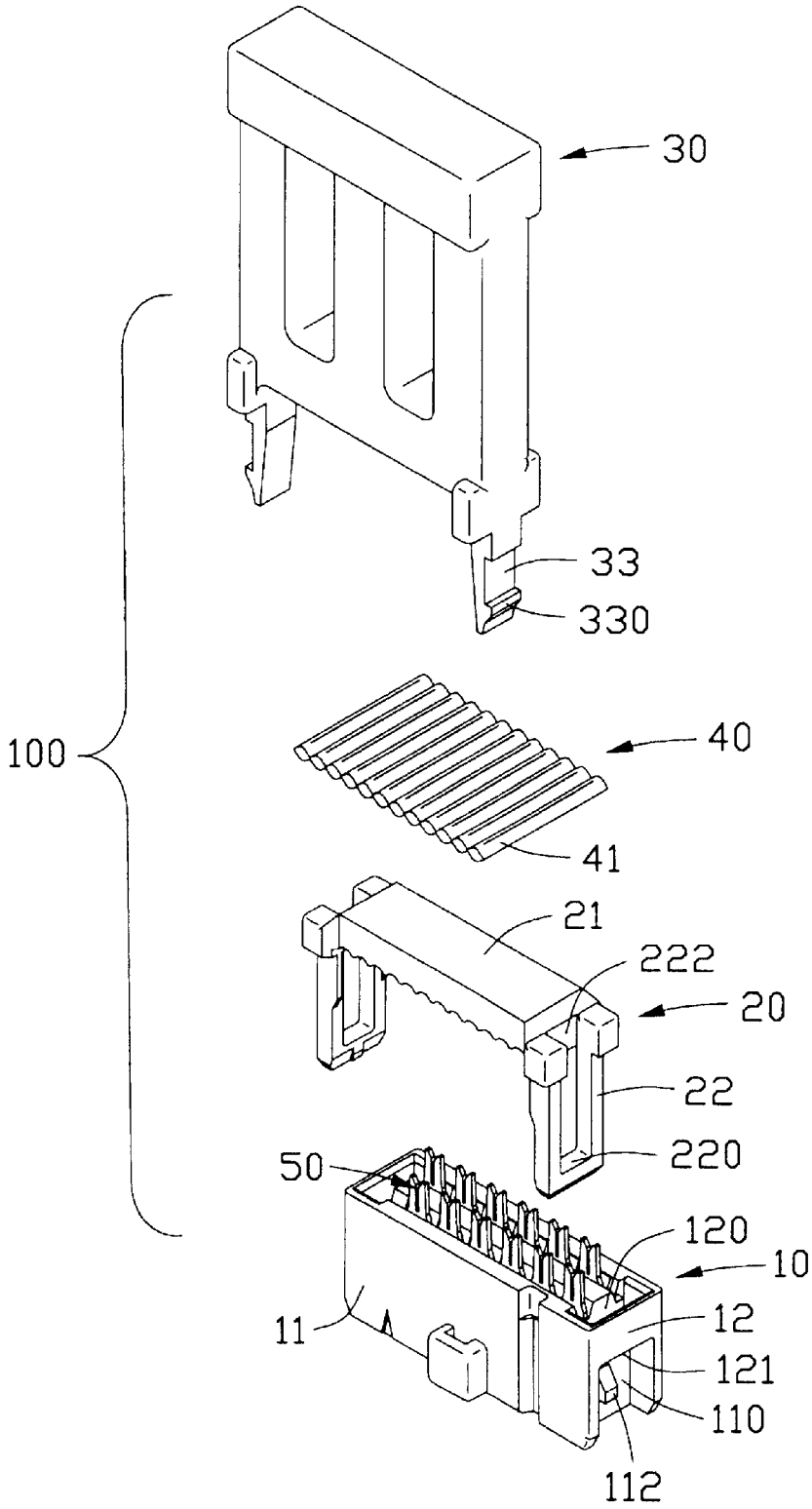
FIG. 1 is an ex ploded, perspective view of an electrical connector assembly in accordance with the present invention.

Reference will now be made to the drawing figures to describe the present invention in detail.

Figure 2:
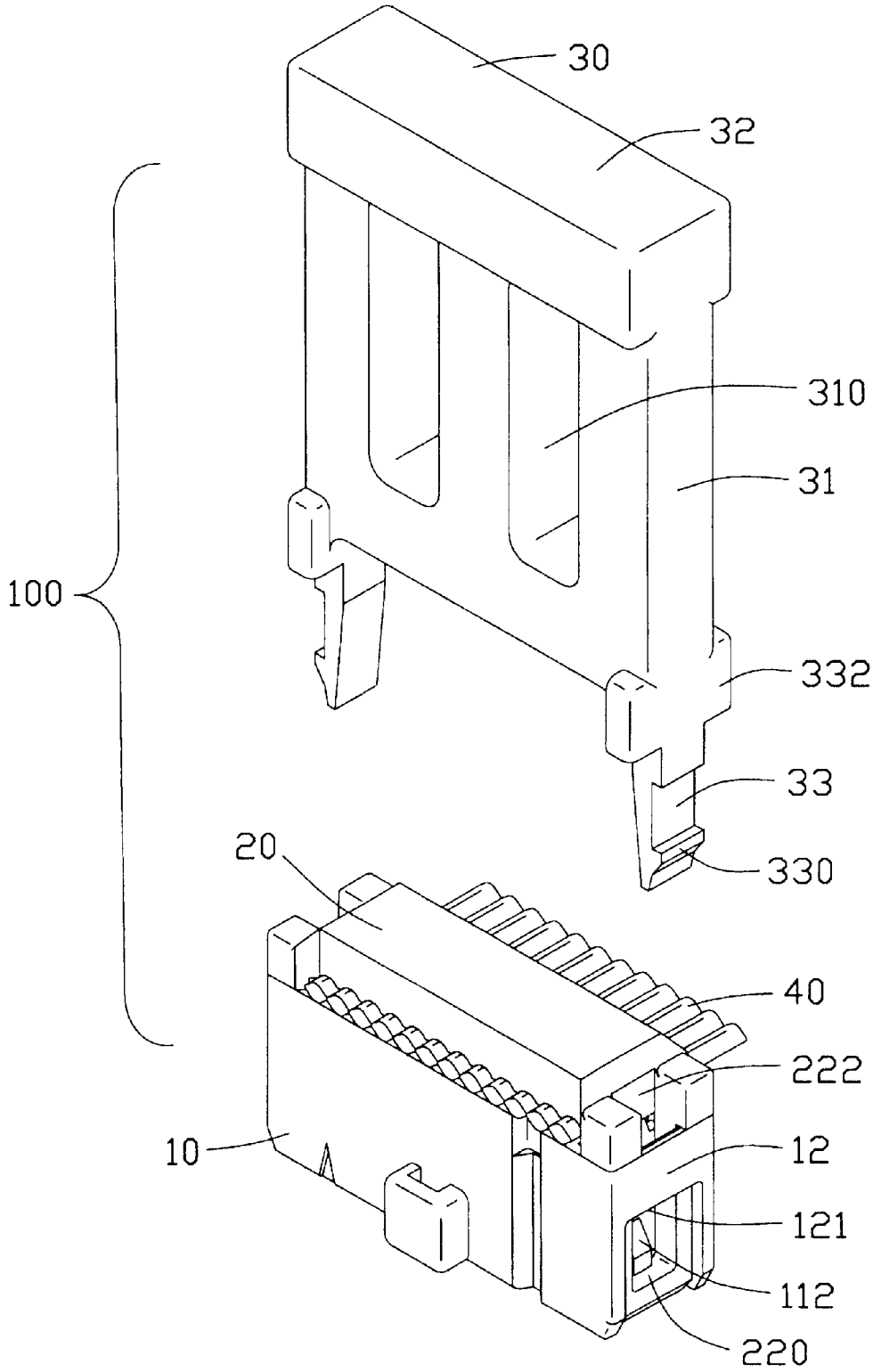
FIG. 2 is a partially assembled view of the electrical connector assembly shown in FIG. 1.
Figure 3:
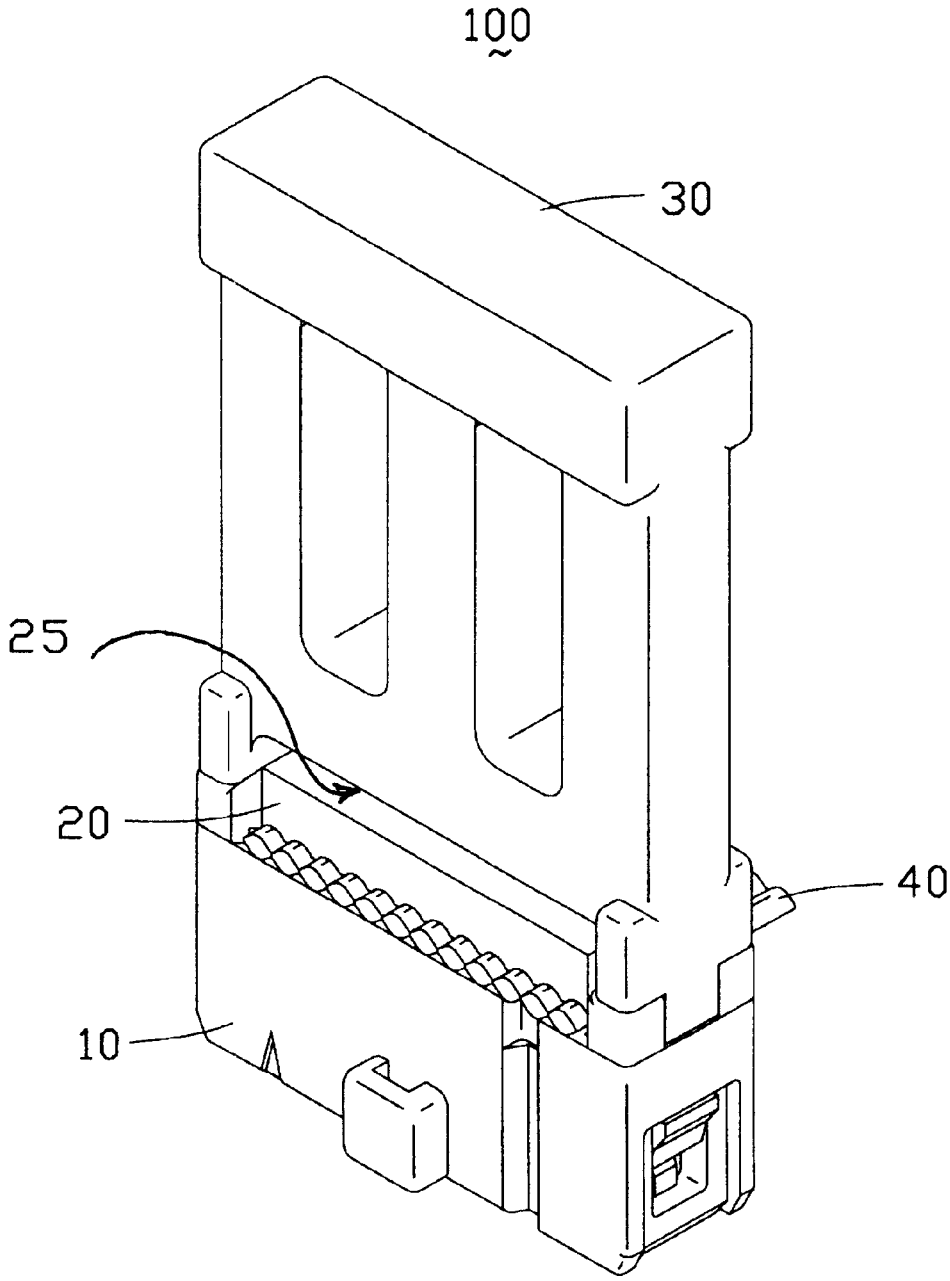
FIG. 3 is an assembled view of the electrical connector assembly shown FIG. 1.

Referring to FIGS. 1–3, an electrical connector assembly 100 in accordance with the present invention comprises an electrical connector, such as an IDC connector, and an external cable 40. The connector includes an insulating base 10 having a plurality of contacts 50, such as IDC contacts, arranged in two rows for electrical connection with parallel extending, individual wires 41 of the external cable 40, a terminating cover 20 attached to the insulating base 10 for holding the cable 40 in terminated relation to the base 10, and a wire strain relief member 30 firmly connecting the terminating cover 20 and the insulating base 10 together to maintain the cable 40 in its terminated position.

The insulating base 10 has an elongated body 11 with a pair of yokes 12 integrally formed at opposite ends of the elongated body 11, each yoke 12 spanning a width of the base 10. Each yoke 12 defines an opening 120 therein and a locking face 121 on a lower side thereof, spaced from a corresponding lateral end 110 of the elongated body 11 a predetermined distance. On the opposite lateral ends 110 of the elongated body 11, a pair of projections 112 are respectively formed.

The terminating cover 20 includes an elongated main body 21 and a pair of latching arms 22 extending downwardly from opposite ends of the main body 21. The latching arms 22 are configured as hasps with a latching face 220 defined thereon for hooking on a corresponding projection 112 on the lateral ends 110 of the elongated body 11. Each latching arm 22 also defines a passing channel 222 therein, which will be described hereinafter.

The wire strain relief member 30 is configured to have a high profile, and is fabricated by molding an insulating plastic material. The wire strain relief member 30 comprises a main portion 31, a holding cap 32 integrally formed on a topside of the main portion 31, and a pair of locking legs 33 extending downwardly from opposite bottom ends of the main portion 31. Each locking leg 33 defines an outwardly projecting hook 330 on a lower side thereof for engaging with a corresponding locking face 121 of the insulating base 10. Each locking leg 33 also forms a pair of shoulders 332 on a top thereof in conjunction with the main portion 31. Each pair of shoulders 332 provides stability for each respective locking leg 33. A pair of vertically extending slots 310 is further defined in the main portion 31 of the wire strain relief member 30 to increase resilience and save material. A width of the holding cap 32 is larger than a width of the main portion 31, to make withdrawal of the wire strain relief member 30 more convenient.

In assembly, particularly referring to FIG. 3, the external cable 40 is firstly positioned on the insulating base 10 prior to assembling the terminating cover 20 to the insulating base 10. The individual wires 41 of the cable 40 are pierced and make electrical contact with the contacts 50 after seating of the terminating cover 20 on the base 10. During seating of the terminating cover 20, the pair of latching arms 22 is received in the openings 120 of the base 10, and lock to the projections 112, with the latching faces 220 abutting against a bottom of the corresponding projections 112. Then, the locking legs 33 of the strain relief member 30 are inserted into the openings 120 of the insulating base 10, passing through the channels 222 formed by the latching arms 22 of the terminating cover 20, locking into place when the hooks 330 abut against the locking face 121 of the corresponding yokes 12, thereby firmly securing the strain relief member 30 on the insulating base 10 and the terminating cover 20 wherein a space 25 is formed between the top face of the main body 21 of the cover 20 and the bottom face of the main portion 31 of the strain relief member 30 for tightly receiving the cable 40 therein.

Compared with conventional strain relief members used in IDC connectors, the strain relief member 30 of the present invention has a simple configuration, the dimensions of which can be easily changed according to the requirements for different applications, while maintaining the same functions and mechanical capabilities. The strain relief member is also cost-efficient since it is easily fabricated.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an external cable having a plurality of parallel extending wires;

an insulating base defining a first dimension along a lengthwise direction and a second dimension along a transverse direction perpendicular to said lengthwise direction, and a third dimension along a vertical direction perpendicular to both said lengthwise and transverse directions;

a plurality of IDC contacts received in said insulating base electrically and mechanically connected with the wires of the cable;

a terminating cover having an elongated main body and a pair of latching arms extending downwardly from two opposite ends thereof and latchably engaged with two opposite ends of the base to fasten the cover to the base with the cable sandwiched therebetween; and a wire strain relief member attached on said insulating base and said terminating cover, said wire strain relief member comprising a pair of locking legs extending downwardly from two opposite ends of the strain relief member and latchably engaged with said two opposite ends of the base to fasten the strain relief member to the base; wherein said strain relief member defines a fourth dimension along said lengthwise direction, a fifth dimension along said transverse direction, and a sixth dimension along the vertical dimension, said fourth dimension being similar to said first dimension, said fifth dimension being similar to said second dimension while the sixth dimension being about two times with regard to the third dimension;

wherein said strain relief member includes a main portion which constitutes most of the sixth dimension while defines a seventh dimension along a transverse direction under a condition that the seventh dimension is smaller than the fifth dimension;

wherein a space is formed between a top face of the main body of the cover and a bottom face of the main portion of the strain relief member for tightly receiving the cable therein;

wherein at least one elongated slot is formed in the main portion with a top portion thereof terminating around a holding cap located at a top portion of the strain relief member;

wherein a vertical dimension of the assembly is not less than a lengthwise dimension thereof.

2. The assembly as described in claim 1, wherein said strain relief member includes a holding cap at a top portion thereof.

* * * * *